US012644285B2

(12) United States Patent
Qin et al.

(10) Patent No.: US 12,644,285 B2
(45) Date of Patent: Jun. 2, 2026

(54) ROOFING SYSTEMS UTILIZING A PRIMER INCLUDING A SILICON-TERMINATED POLYMER

(71) Applicant: Amrize Technology Switzerland LLC, Zug (CH)

(72) Inventors: Zengquan Qin, Brentwood, TN (US); Jiansheng Tang, Westfield, IN (US); Dharamdeep Jain, Akron, OH (US)

(73) Assignee: Amrize Technology Switzerland LLC, Zug (CH)

( * ) Notice: Subject to any disclaimer, the term of this patent is extended or adjusted under 35 U.S.C. 154(b) by 260 days.

(21) Appl. No.: 18/260,844

(22) PCT Filed: Jan. 17, 2022

(86) PCT No.: PCT/US2022/012683

§ 371 (c)(1),
(2) Date: Jul. 10, 2023

(87) PCT Pub. No.: WO2022/155576

PCT Pub. Date: Jul. 21, 2022

(65) Prior Publication Data

US 2024/0093497 A1 Mar. 21, 2024

Related U.S. Application Data

(60) Provisional application No. 63/137,795, filed on Jan. 15, 2021.

(51) Int. Cl.

| | |
|---|---|
| ***E04D 5/14*** | (2006.01) |
| ***E04D 1/28*** | (2006.01) |
| ***E04D 1/34*** | (2006.01) |

(52) U.S. Cl.

CPC ..... *E04D 5/148* (2013.01); *E04D 1/28* (2013.01); *E04D 1/34* (2013.01); *E04D 2001/3435* (2013.01)

(58) Field of Classification Search

CPC ..... E04D 5/148; E04D 5/142; E04D 1/28; E04D 1/34; E04D 2001/3435; B32B 7/04

See application file for complete search history.

(56) References Cited

U.S. PATENT DOCUMENTS 5,504,136 A * 4/1996 Davis ..... E04D 5/148 525/240
5,520,761 A * 5/1996 Kalwara ..... C09J 123/22 156/281

(Continued)

FOREIGN PATENT DOCUMENTS

JP 5356729 B2 * 12/2013

OTHER PUBLICATIONS

International Search Report and Written Opinion for corresponding PCT/US2022/012683 dated Mar. 16, 2022 (14 pp).

*Primary Examiner* — Adriana Figueroa
(74) *Attorney, Agent, or Firm* — Kenner Renner; Arthur M. Reginelli

(57) ABSTRACT

A method of installing a roof system, the method comprising (i) providing a first membrane panel including a polymeric planar body having a top planar surface and a bottom planar surface; (ii) securing the first membrane panel to a roof substrate; (iii) providing a second membrane panel including a polymeric planar body having a top planar surface and a bottom planar surface; (iv) positioning the second membrane panel adjacent to the first membrane panel so that the second membrane panel overlaps the first membrane panel in a lap region; (v) applying a primer composition to the top planar surface of the first membrane panel in the lap region to form a first primed surface; (vi) optionally applying a primer composition to the bottom planar surface of the second membrane panel in the lap region to form a second primed surface; (vii) applying an adhesive to at least one of the first primed surface or the second primed surface; and (Continued)

(viii) seaming the first membrane panel to the second membrane panel with the adhesive, where the primer composition applied to the first membrane panel and the primer composition optionally applied to the second membrane panel includes a silyl-terminated polymer.

13 Claims, 2 Drawing Sheets

(56) References Cited

U.S. PATENT DOCUMENTS 5,563,217 A * 10/1996 Davis ..... B32B 3/06 428/521
5,849,133 A 12/1998 Senderling et al.
5,859,114 A * 1/1999 Davis ..... E04D 5/142 525/240
5,976,292 A * 11/1999 Barksdale ..... E04D 5/142 156/281
6,008,305 A 12/1999 Wang et al.
7,977,399 B2 7/2011 Hasegawa
8,389,630 B2 3/2013 Tamai et al.
8,701,367 B2 * 4/2014 Georgeau ..... E04D 5/14 52/746.1
8,709,565 B2 * 4/2014 Kalwara ..... E04D 5/148 52/309.1
8,809,479 B2 * 8/2014 Huang ..... C07F 7/18 528/30
9,932,437 B2 4/2018 Huang et al.
2005/0070649 A1 3/2005 Fisher
2007/0264471 A1 * 11/2007 Kalwara ..... B29C 65/5021 427/407.1
2010/0024955 A1 2/2010 Kalwara et al.
2010/0200148 A1 * 8/2010 Douglas ..... E04B 1/665 427/508
2014/0261965 A1 9/2014 Tang et al.
2015/0337534 A1 * 11/2015 Miller ..... C08G 18/4825 52/309.3
2016/0362893 A1 * 12/2016 Tang ..... C08G 65/336
2020/0299965 A1 9/2020 Tang et al.

* cited by examiner

ROOFING SYSTEMS UTILIZING A PRIMER INCLUDING A SILICON-TERMINATED POLYMER

This application is a national-stage application of PCT/US2022/012683 filed on Jan. 17, 2022, which claims the benefit of U.S. provisional application No. 63/137,795 filed on Jan. 15, 2021, which are incorporated herein by reference.

FIELD OF THE INVENTION

Embodiments of the invention are directed toward roofing systems that include lap seams formed by using a primer that includes a silicon-terminated polymer.

BACKGROUND OF THE INVENTION

Large, flexible polymeric sheets, which are often referred to as membranes or panels, are used in the construction industry to cover flat or low-sloped roofs. These membranes provide protection to the roof from the environment, particularly in the form of a waterproof barrier. As is known in the art, commercially popular membranes include thermoset membranes such as those including cured EPDM (i.e., ethylene-propylene-diene terpolymer rubber) or thermoplastics such as TPO (i.e., thermoplastic olefins).

These membranes are typically delivered to a construction site in a bundled roll, transferred to the roof, and then unrolled and positioned. The sheets are then affixed to the building structure by employing varying techniques such as mechanical fastening, ballasting, and/or adhesively adhering the membrane to the roof. The roof substrate to which the membrane is secured may be one of a variety of materials depending on the installation site and structural concerns. For example, the surface may be a concrete, metal, or a wood deck, it may include insulation or recover board, and/or it may include an existing membrane.

In addition to securing the membrane to the roof, the individual membrane panels, together with flashing and other accessories, are positioned and adjoined together so as to achieve a waterproof barrier on the roof. Typically, the edges of adjoining panels are overlapped, and these overlapping portions are adjoined (i.e. seamed) to one another through a number of methods depending upon the membrane materials and exterior conditions. One approach involves providing adhesives or adhesive tapes between the overlapping portions, thereby creating a water resistant seal.

Before preparing EPDM roofing seams, it is necessary that any talc or mica anti-stick agents be removed from the membrane surface prior to applying the adhesive system to be used to join adjacent membrane sheets together. If the removal process is not thorough, the particles of talc or mica prevent the adhesive material employed from thoroughly coating the surface area covered by the anti-stick agent. This then results in inferior adhesion, subsequent decoupling of the joint, and eventual penetration of water through the seam.

Therefore, it is desirable to use a primer on the EPDM membrane substrate before applying the neoprene or butyl based adhesives. These primers generally include a dilute solution of rubber and resins in a suitable solvent. The primer is applied to the surfaces to be joined prior to application of the membrane adhesive in order to improve the final seam adhesion. The application of the primer and the evaporation of the solvent occur before the application of the splice adhesive. The strength and durability of the final bond between adhesive and substrate depend greatly on the strength of the bond created by the primer. Certain conventional commercial primers provide relatively poor bond strengths when used with neoprene or butyl based adhesives.

SUMMARY OF THE INVENTION

One or more embodiments of the present invention provide a method of installing a roof system, the method comprising (i) providing a first membrane panel including a polymeric planar body having a top planar surface and a bottom planar surface; (ii) securing the first membrane panel to a roof substrate; (iii) providing a second membrane panel including a polymeric planar body having a top planar surface and a bottom planar surface; (iv) positioning the second membrane panel adjacent to the first membrane panel so that the second membrane panel overlaps the first membrane panel in a lap region; (v) applying a primer composition to the top planar surface of the first membrane panel in the lap region to form a first primed surface; (vi) optionally applying a primer composition to the bottom planar surface of the second membrane panel in the lap region to form a second primed surface; (vii) applying an adhesive to at least one of the first primed surface or the second primed surface; and (viii) seaming the first membrane panel to the second membrane panel with the adhesive, where the primer composition applied to the first membrane panel and the primer composition optionally applied to the second membrane panel includes a silyl-terminated polymer.

Other embodiments of the present invention provide a method of installing a roof system, the method comprising (i) providing a first membrane panel including a polymeric planar body having a top planar surface and a bottom planar surface, where the first membrane includes a primer layer on the top surface in a lap region of the membrane; (ii) securing the first membrane panel to a roof substrate; (iii) providing a second membrane panel including a polymeric planar body having a top planar surface and a bottom planar surface, where the second membrane optionally includes a primer layer on the bottom planer surface in a lap region of the membrane; (iv) positioning the second membrane panel adjacent to the first membrane panel so that the second membrane panel overlaps the first membrane panel in the lap regions of the respect membranes; (v) applying an adhesive to at least one of the primer layers of the respective membranes; and (vi) seaming the first membrane panel to the second membrane panel with the adhesive, where the primer layer is pre-formed on the respective membranes prior to delivery to the roof substrate by applying a primer composition including a silyl-terminated polymer.

Still other embodiments of the present invention provide a method of installing a roof system, the method comprising (i) providing a first membrane panel including a polymeric planar body having a top planar surface and a bottom planar surface, where the first membrane includes a primer layer on the top surface in a lap region of the membrane and an adhesive layer disposed on the primer layer; (ii) securing the first membrane panel to a roof substrate; (iii) providing a second membrane panel including a polymeric planar body having a top planar surface and a bottom planar surface, where the second membrane optionally includes a primer layer on the bottom planer surface in a lap region of the membrane; (iv) positioning the second membrane panel adjacent to the first membrane panel so that the second membrane panel overlaps the first membrane panel in the lap regions of the respect membranes; and (v) seaming the first membrane panel to the second membrane panel with the adhesive, where the primer layer is pre-formed on the respective membranes prior to delivery to the roof substrate by applying a primer composition including a silyl-terminated polymer, and where the adhesive is pre-applied the membrane panel prior to delivery to the roof substrate.

Yet other embodiments of the present invention provide a membrane composite comprising (i) a polymeric membrane panel having a first planar surface and a second planar surface; (ii) a primer layer applied along a lap area on the first planar surface, where the primer layer includes a cured residue of a silyl-terminated polymer; (iii) a splice tape disposed on the primer layer; and (iv) a release member removably secured to the splice tape.

Other embodiments of the present invention provide a pre-primed roofing membrane comprising (i) a polymeric membrane panel having a first planar surface and a second planar surface; (ii) a primer layer applied along a lap area on the first planar surface, where the primer layer includes a cured residue of a silyl-terminated polymer; and (iii) optionally a release member removably secured to the primer layer.

DETAILED DESCRIPTION OF ILLUSTRATIVE EMBODIMENTS

Figure 1:
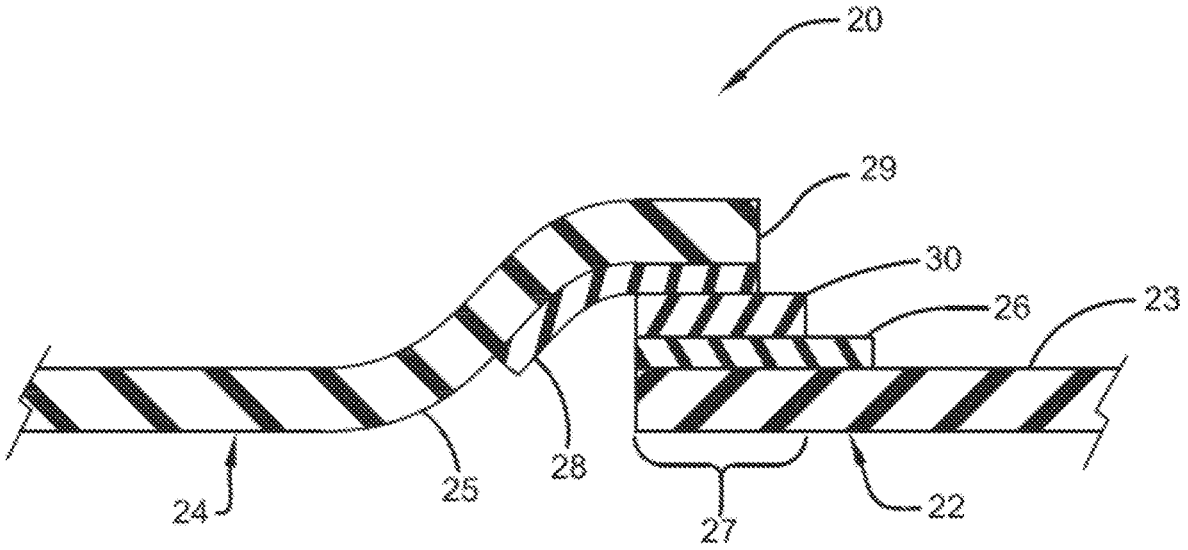
FIG. 1 is a cross-sectional side view of a roofing system seam according to embodiments of the invention.

Embodiments of the invention are based, at least in part, on the discovery of a method for forming roofing membrane systems by utilizing a lap-edge primer that includes a silicon-terminated polymer. The lap-edge primer has unexpectedly been found to exhibit desirable properties including the ability to form advantageous seams when utilized in conjunction with conventional adhesives, such as splice tape. The use of the primer compositions of this invention provides several advantages including the formation of strong lap seals, and the ability to apply the primer composition, especially in the field, with reduced VOC release to the environment. The primer composition has also proven to be versatile. For example, in some embodiments, the primer composition can be applied in the field, and then an adhesive is subsequently field applied to form the seam. Alternatively, the primer composition can be pre-applied prior to delivery to location of installation (e.g. in a fabrication facility). A release film can be applied to the primed area, or the primed area can remain exposed during storage, shipping and handling without deleterious impact to subsequent formation of a seam. In still other embodiments, following pre-application of the primer composition (e.g. at a fabrication facility), an adhesive, such as a pressure-sensitive adhesive tape, can likewise be pre-applied to the primed area to form a composite membrane.

Primer Composition

As suggested above, the methods of the present invention employ a lap-edge primer composition that includes a silicon-terminated polymer. In one or more embodiments, the lap-edge primer compositions, which may also be referred to as uncured primer compositions or simply primer composition, include a polymer having silicon-containing hydrolyzable terminal group and optionally one or more of a plasticizer, a moisture scavenger, an adhesion promoter, and a catalyst. Other optional ingredients may include an antioxidant, a stabilizer, a tackifier, filler, a crosslink inhibitor (a.k.a. retarder), a plasticizer, a thixotropic compound, and/or an anti-degradant.

Silane-Terminated Polymers

In one or more embodiments, the polymer having a silicon-containing hydrolyzable terminal group may be referred to as a silane-terminated polymer or a silyl-terminated polymer. The term "silicon-containing hydrolyzable terminal group" refers to a group wherein at least one silicon atom is associated with a hydrolyzable group, such as a hydrocarbyloxy group (e.g. methoxy or ethoxy group), and is subject to hydrolysis and polymerization through interaction with water (i.e., moisture). In one or more embodiments, the polymer is telechelic, which refers to the fact that the polymer is linear and include a silicon-containing hydrolyzable terminal group at each end of the polymer chain. In one or more embodiments, the silyl terminal end includes at least two, and in other embodiments at least three hydrolyzable groups (e.g. the hydrolyzable group is a trimethoxy or triethoxy silyl group).

In one or more embodiments, the backbone of the silyl-terminated polymer includes one or more silicon-containing repeat units (e.g. a polysiloxy backbone). In other embodiments, the backbone of the silyl-terminated polymer is devoid of silicon-containing internal repeat units (e.g. a non-siloxy backbone). In one or more embodiments, the backbone of the silyl-terminated polymer includes a polyether, polyester, polyurethane (SPUR), or the like.

Suitable polymers having silicon-containing hydrolyzable terminal groups are commercially available and/or can be prepared in accordance with techniques known in the art. Examples of suitable commercially available polymers having silicon-containing hydrolyzable terminal groups are Geniosil™ STP-E 35, which is believed to be a trimethoxysilylpropyl-carbamate-terminated polyether, and Geniosil™ STP-E 30, which is believed to be a silane-terminated polyether with dimethoxy(methyl)silyl methylcarbamate terminal groups, both of which are available from Wacker Chemical. Another commercially available polymer having silicon-containing hydrolyzable terminal groups include "SPUR+" silane-terminated polyurethanes, which are available from Momentive. Another suitable commercially available polymer is "MS" silyl-terminated polyether (S227H, S303, S327, S303H, SAX350), which are available from Kaneka.

In one or more embodiments, the silyl-terminated polymers have a number average molecular weight greater than 500 g/mole, in other embodiments greater than 1,000 g/mole, in other embodiments greater than 2,500 g/mole, and in other embodiment greater than 5,000 g/mole. In these or other embodiments, the silyl-terminated polymers have a number average molecular weight of less than 30,000 g/mole, in other embodiments less than 20,000 g/mole, in other embodiments less than 15,000 g/mole, in other embodiments less than 10,000 g/mole, in other embodiments less than 7,000 g/mole, in other embodiments less than 5,000 g/mole, in other embodiments less than 4,000 g/mole, and in other embodiments less than 3,000 g/mole. In one or more embodiments, the silyl-terminated polymers have a number average molecular weight of from about 500 to 30,000, in other embodiments from about 1,000 to about 15,000, and in other embodiments from about 1,500 to about 7,000 g/mole. In these or other embodiments, the silyl-terminated polymers are characterized by a polydispersity of from about 1.0 to about 5.0, in other embodiments from about 1.2 to about 3.5, and in other embodiments from about 1.3 to about 2.5.

In one or more embodiments, the silyl-terminated polymers are characterized by a Brookfield Viscosity, which can be determined by ASTM D789 or D4878 using a #2 spindle at 20 r.p.m. at 20° C. and 50% relative humidity. In one or more embodiments, the Brookfield Viscosity (#2 spindle at 20 r.p.m.) of the silyl terminated polymers is greater than 1000, in other embodiments greater than 1500, and in other embodiments greater than 2000 centipoise. In these or other embodiments, the of the Brookfield Viscosity (#2 spindle at 20 r.p.m.) of the curable sealant compositions is less than 10,000, in other embodiments less than 7,500, in other embodiments less than 6,000, in other embodiments less than 5,000, in other embodiments less than 4,000, in other embodiments less than 3,000, in other embodiments less than 2,500, and in other embodiments less than 1000 centipoise. In one or more embodiments, the Brookfield Viscosity (#2 spindle at 20 r.p.m.) of the curable sealant compositions is from about 1000 to about 10,000, in other embodiments from about 1500 to about 5000, and in other embodiments from about 1700 to about 3000 centipoise.

Plasticizers

In one or more embodiments, a plasticizer is employed in the primer compositions of this invention. Examples of a plasticizer include phthalic acid esters (such as dioctyl phthalate, diisooctyl phthalate, dibutyl phthalate, diundecyl phthalate, diisononyl phthalate, diisodecyl phthalate, diisodocecyl phthalate and butylbenzyl phthalate); aliphatic dibasic acid esters (such as dioctyl adipate, isodecyl succinate, and dibutyl sebacate); glycol esters (such as diethylene glycol dibenzoate and pentaerythritol ester); aliphatic esters (such as butyl oleate and methyl acetylricinoleate); phosphoric acid esters (such as tricresyl phosphate, trioctyl phosphate, and octyldiphenyl phosphate); epoxy plasticizers (such as epoxidated soybean oil, epoxidated linseed oil, and benzyl epoxystearate); polyester plasticizers (such as polyesters of dibasic acid and a divalent alcohol); polyethers (such as polypropylene glycol and its derivatives); polystyrenes (such as poly-α-methylstyrene and polystyrene); polybutadiene butadiene-acrylonitrile copolymer; polychloroprene; polyisoprene; polybutene; chlorinated paraffins; benzoic esters; glycol esters; phosphoric esters; sulfonic esters; and mixtures thereof, wherein any given compound is different than an ingredient otherwise included in the composition of the invention.

In addition, high-molecular weight plasticizers can also be used. Specific examples of such high-molecular weight plasticizer include, but are not limited to, vinyl polymers obtainable by polymerizing a vinyl monomer by various methods; polyalkylene glycol esters such as diethyl ene glycol dibenzoate, triethylene glycol dibenzoate and pentaerythritol esters; polyester plasticizers obtainable from a dibasic acid, such as sebacic acid, adipic acid, azelaic acid or phthalic acid, and a dihydric alcohol, such as ethylene glycol, diethylene glycol, triethylene glycol, propylene glycol or dipropylene glycol; polyethers such as polyether polyols, e.g. polyethylene glycol, polypropylene glycol and polytetramethylene glycol that have a molecular weight of 500 or more, and even further 1,000 or more, and derivatives of these as obtainable by converting the hydroxyl groups of these polyether polyols to an ester, ether or the like groups; polystyrenes such as polystyrene and poly-α-methylstyrene; polybutadiene, polybutene, polyisobutylene, butadiene-acrylonitrile, polychloroprene and the like. In one or more specific embodiments, plasticizers include propylene glycol dibenzoate, diisononyl phthalate, and soy methyl esters, Mesamol II, HB-40, butylbenzylphthalate. In other specific embodiments, the plasticizers employed are phthalic acid esters. In one or more embodiments, the plasticizers may include high boiling solvents that promote tackification, lowering of viscosity, and sprayability.

In one or more embodiments, the plasticizer is a non-phthalic plasticizer. In one or more embodiments, the plasticizer is a glycol ether ester. In one or more embodiments, glycol ether esters may be prepared from glycol ethers, for example by reaction with carboxylic acids, carboxylic acid chlorides, anhydrides and inorganic acids. In one or more embodiments, the plasticizer may be prepared by reacting a glycol ether and a carboxylic acid. In one or more embodiments, the glycol ether may be represented by the formula R'OH, and the carboxylic acid may be represented by the formula R"COOH, where R' is a monovalent organic group that includes at least one ether linkage, and R" is a monovalent organic group.

Examples of carboxylic acids include formic acid, acetic acid, propionic acid, butyric acid, benzoic acid, pentanoic acid, hexanoic acid, heptanoic acid, octanoic acid, nonanoic acid, decanoic acid, diacids including butanedioic acid, pentaedioic acid, hexanedioic acid, heptanedioic acid, octanedioic acid, nonanedioic acid, and decanedioic acid, and combinations and isomers thereof.

Glycol ethers include alkyl ethers of ethylene glycol or propylene glycol. In one or more embodiments, glycol ethers may be prepared by reacting an alcohol (e.g., methanol, ethanol, propanol, butanol, or hexanol) with ethylene oxide or propylene oxide. Glycol ethers are sometimes classified as e-series and p-series glycol ethers, where the "e" and "p" indicate that the glycol ether was derived from ethylene oxide or propylene oxide, respectively.

Examples of glycol ethers include 2-methoxyethanol (also known as ethylene glycol monomethyl ether, with a chemical formula of $CH_3OCH_2CH_2OH$), 2-ethoxyethanol (also known as ethylene glycol monoethyl ether, with a chemical formula of $CH_3CH_2OCH_2CH_2OH$), 2-propoxyethanol (also known as ethylene glycol monopropyl ether, with a chemical formula of $CH_3CH_2CH_2OCH_2CH_2OH$), 2-isopropoxyethanol (also known as ethylene glycol monoisopropyl ether, with a chemical formula of $(CH_3)_2CHOCH_2CH_2OH$), 2-butoxyethanol (also known as ethylene glycol monobutyl ether, with a chemical formula of $CH_3CH_2CH_2CH_2OCH_2CH_2OH$), 2-phenoxyethanol (also known as ethylene glycol monophenyl ether, with a chemical formula of $C_6H_5OCH_2CH_2OH$), 2-benzyloxyethanol (also known as ethylene glycol monobenzyl ether, with a chemical formula of $C_6H_5CH_2OCH_2CH_2OH$), 1-methoxy-2-propanol (also known as propylene glycol methyl ether, with a chemical formula of $CH_3OCH_2CH(OH)CH_3$), 2-(2-methoxyethoxy)ethanol (also known as diethylene glycol monomethyl ether or methyl carbitol, with a chemical formula of $CH_3OCH_2CH_2OCH_2CH_2OH$), 2-(2-ethoxyethoxy) ethanol (also known as diethylene glycol monoethyl ether or carbitol cellosolve, with a chemical formula of $CH_3CH_2OCH_2CH_2OCH_2CH_2OH$), 2-(2-butoxyethoxy) ethanol (also known as diethylene glycol mono-n-butyl ether or butyl carbitol, with a chemical formula of $CH_3CH_2CH_2CH_2OCH_2CH_2OCH_2CH_2OH$), dipropyleneglycol methyl ether, and combinations, complexes, and isomers thereof. In one or more embodiments, the glycol ether is bis [2-(2-butoxyethoxy) ethoxy]methane.

Examples of non-phthalic plasticizers also include methyl cellosolve acetate, ethyl cellosolve acetate, methyl carbitol acetate, ethyl carbitol acetate, ethylene glycol ethyl ether acetate, propylene glycol methyl ether acetate, 3-methyl-3-methoxybutylacetate, diethylene glycol diacetate, dipropylene glycol dibutyrate, hexylene glycol diacetate, glycol diacetate, methyl glycol acetate, ethyl glycol acetate, butyl glycol acetate, ethyl diglycol acetate, butyl diglycol acetate, diethylene glycol dibenzoate, triethylene glycol dibenzoate, and ethyl-3-ethoxypropionate.

In one or more embodiments, the non-phthalic plasticizer may include a glycol ether. Useful glycol ethers include those describe above with reference to the glycol esters. In this regard, the discussion above with respect to glycol ethers is incorporated herein.

In one or more embodiments, the non-phthalic plasticizer may be characterized by a weight average molecular weight of greater than 100, in other embodiments, greater than 110, in other embodiments, greater than 120. In one or more embodiments, non-phthalic plasticizer may be characterized by a weight average molecular weight of less than 1000, in other embodiments, less than 900, in other embodiments, less than 800. In one or more embodiments, non-phthalic plasticizer may be characterized by a weight average molecular weight of from about 100 to about 1000, in other embodiments, from about 110 to about 900, in other embodiments, from about 120 to about 800.

In one or more embodiments, the non-phthalic plasticizer is a liquid at room temperature and at standard pressure, and may be characterized by a boiling point of greater than 100° F., in other embodiments, greater than 150° F., in other embodiments, greater than 200° F. In one or more embodiments, non-phthalic plasticizer may be characterized by a boiling point of less than 600° F., in other embodiments, less than 550° F., in other embodiments, less than 500° F. In one or more embodiments, non-phthalic plasticizer may be characterized by a boiling point of from about 100 to about 600° F., in other embodiments, from about 150 to about 550° F., in other embodiments, from about 200 to about 500° F., all of the above measured at atmospheric pressure.

Non-phthalic plasticizers are commercially available, for example from Hallstar Industrial under the trade name Plasthall 190. Advantageously, phthalate plasticizers, which include phthalic acid esters such as dioctyl phthalate, diisooctyl phthalate, dibutyl phthalate, diundecyl phthalate, diisononyl phthalate, diisodecyl phthalate, diisodocecyl phthalate and butylbenzyl phthalate, may be reduced or eliminated from the adhesive composition.

Moisture Scavenger

In one or more embodiments, a moisture scavenger is employed in the primer compositions of this invention. Moisture scavengers that may be employed include chemical moisture scavengers and physical moisture scavengers that absorb and/or adsorb moisture. Examples of chemical moisture scavengers include vinyl-trimethoxysilane. An example of a physical moisture scavenger that may be employed is 3 A Sieves from UOP, which is a zeolite having 3 Angstrom pores capable of trapping moisture. Other examples of moisture scavengers include oxazoladines and calcium oxide.

As suggested above, a low VOC-generating moisture scavenger may be employed within the adhesive compositions of the present invention. In one or more embodiments, these moisture scavengers are silanes including at least one organo functional group and at least one hydrolyzable group that, upon hydrolysis, generates a non-volatile organic compound or low vapor volatile organic compound (e.g., a glycol or other polyhydric alcohol of relatively high boiling point and/or low vapor pressure). Useful moisture scavenger compounds are described in U.S. Pat. No. 8,088,940, which is incorporated herein by reference.

In one or more embodiments, the moisture scavengers can be defined by the formula $$(X^1_aX^2_bX^3_cSiR^1)_dZ$$

where each occurrence of $R^1$ is independently a chemical bond between a silicon atom and a carbon atom of the Z group; a hydrocarbyl group of 1 to 10 carbon atoms; or a heterocarbyl of 1 to 10 carbon atoms and at least one heteroatom of nitrogen or oxygen; each occurrence of $X^1$ is a monovalent alkyl or aryl group of from 1 to 6 carbon atoms or a monovalent heterocarbyl group of from 2 to 8 carbon atoms and at least two heteroatom selected from the group consisting of oxygen and nitrogen, with the proviso that one heteroatom is bonded to a carbon atom of the heterocarbyl group and to the silicon atom; each occurrence of $X^2$ is a divalent heterocarbyl group of from 2 to 8 carbon atoms and at least two heteroatoms selected from the group consisting of oxygen and nitrogen, with the proviso that two heteroatoms are bonded to two different carbon atoms of the heterocarbyl group and to the same silicon atom; each occurrence of $X^3$ is a trivalent heterocarbyl group of from about 3 to 8 carbons and at least three heteroatoms selected from the group consisting of oxygen and nitrogen, with the proviso that three heteroatoms are bonded to three different carbon atoms of the heterocarbyl group and to the same silicon atom; each Z is a monovalent or polyvalent organo-functional group of valence d selected from the group consisting of hydrogen, amino, carbamato, epoxy, ureido and alkenyl groups, provided, where Z does not possess a carbon atom, $R^1$ cannot be a chemical bond; and, each occurrence of a, b, c and d are integers, wherein a is 0 to 3; b is 0 or 1; c is 0 or 1; and d is 1 to 4; with the proviso that when c is 0, then a+2b=3 and when b is 1, then a=1 and c=0.

In one or more embodiments, the moisture scavenger is a glycoxysilane moisture scavenger. In particular embodiments, the glycoxysilane moisture scavenger may be defined by the formula:

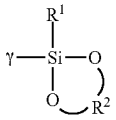

where $R^1$ is a monovalent organic group, $R^2$ is a divalent organic group, and y is an electron donating group. In particular embodiments, $R^1$ is a hydrocarbyl group. In other embodiments, $R^1$ is a hydrocarbyloxy group. In one or more embodiments, y is a vinyl group.

In one or more embodiments, the monovalent organic groups of the glycoxysilane may be hydrocarbyl groups, which include, but not limited to, alkyl, cycloalkyl, alkenyl, cycloalkenyl, aryl, allyl, aralkyl, alkaryl, or alkynyl groups. Hydrocarbyl groups also include substituted hydrocarbyl groups, which refer to hydrocarbyl groups in which one or more hydrogen atoms have been replaced by a substituent such as a hydrocarbyl group. In one or more embodiments, these groups may include from one, or the appropriate minimum number of carbon atoms to form the group, to about 20 carbon atoms. These groups may or may not contain heteroatoms. Suitable heteroatoms include, but not limited to, nitrogen, boron, oxygen, silicon, sulfur, tin, and phosphorus atoms. In one or more embodiments, the cycloalkyl, cycloalkenyl, and aryl groups are non-heterocyclic groups. In these or other embodiments, the substituents forming substituted hydrocarbyl groups are non-heterocyclic groups.

In one or more embodiments, the moisture scavenger may be 3 A Sieves from UOP, which is a zeolite having 3 Angstrom pores capable of trapping.

In one or more embodiments, the monovalent organic groups of the glycoxysilane may be hydrocarbyloxy groups which include, but are not limited to, alkoxy, cycloalkoxy, substituted cycloalkoxy, alkenyloxy, cycloalkenyloxy, substituted cycloalkenyloxy, aryloxy, allyloxy, substituted aryloxy, aralkyloxy, alkaryloxy, or alkynyloxy groups. Substituted hydrocarbyloxy groups include hydrocarbyloxy groups in which one or more hydrogen atoms attached to a carbon atom have been replaced by a substituent such as an alkyl group. In one or more embodiments, the hydrocarbyloxy groups may include from one, or the appropriate minimum number of carbon atoms to form the group, to 20 carbon atoms. The hydrocarbyloxy groups may contain heteroatoms such as, but not limited to nitrogen, boron, oxygen, silicon, sulfur, and phosphorus atoms.

In one or more embodiments, the divalent organic groups of the glycoxysilane may include hydrocarbylene groups such as, but not limited to, alkylene, cycloalkylene, alkenylene, cycloalkenylene, alkynylene, cycloalkynylene, or arylene groups. Hydrocarbylene groups include substituted hydrocarbylene groups, which refer to hydrocarbylene groups in which one or more hydrogen atoms have been replaced by a substituent such as a hydrocarbyl group. In one or more embodiments, these groups may include from one, or the appropriate minimum number of carbon atoms to form the group, to about 20 carbon atoms. These groups may or may not contain heteroatoms. Suitable heteroatoms include, but not limited to, nitrogen, boron, oxygen, silicon, sulfur, tin, and phosphorus atoms. In one or more embodiments, the cycloalkylene, cycloalkenylene, and arylene groups are non-heterocyclic groups. In these or other embodiments, the substituents forming substituted hydrocarbylene groups are non-heterocyclic groups.

Specific examples of glycoxysilane compounds include vinyl, methyl, 2-methyl-1,3-propanedioxy silane, which may also be referred to as 2,5-dimethyl-2-vinyl [1,2,3] dioxasilinane. These moisture scavengers are available under the tradename Y-15866 (Momentive).

Adhesion Promoter

In one or more embodiments, an adhesion promoter is employed in the primer compositions of this invention. In one or more embodiments, the adhesion promoter includes a non-polymeric silicon-containing hydrocarbon compound that has a lower molecular weight than the polymer having a silicon-containing hydrolysable group (i.e. the silane-terminate polymer). Also, the adhesion promoter includes at least one hydrolyzable group capable of reacting with a hydrolyzed functional group on the polymer having silicon-containing hydrolyzable terminal groups, and includes at least one moiety capable of interacting (i.e., promoting adhesion) with materials that are to be bonded with one another (such as a rubber membrane material). The expression non-polymeric, as used to modify the silicon-containing hydrocarbon compound is meant to exclude polymers and copolymers having at least 10 repeat units or monomeric units, such as urethane prepolymers having silicon-containing hydrolyzable terminal groups, but is meant to encompass oligomeric silicon-containing hydrolyzable compounds having fewer than 10 repeat units or monomers, and which are useful for promoting adhesion between a substrate and a cured adhesive composition.

Suitable adhesion promoters include those having an alkoxysilyl, a ketoximesilyl, or an alkenoxysilyl group as the hydrolyzable group, and exemplary such compositions include vinyltris(2-methoxyethoxy) silane, 3-methacryloxypropyltrimethoxysilane, 2-(3,4-epoxycyclohexyl)ethyl trimethoxysilane, 3-glycidoxypropyltrimethoxysilane, 3-glycidoxypropylmethyldiethoxysilane, N-(2-aminoethyl)3-aminopropyltrimethoxysilane, 3-aminopropyltriethoxysilane, 3-(N-aminomethylbenzylamino)propyltrimethoxysilane, 3-mercaptopropyltrimethoxysilane, 3-aminopropyltris (methylethylketoxime)silane, 3-glycidoxy propyltriisopropenoxysilane, and 3-glycidoxypropylmethyldiisopropenoxysilane. In certain embodiments, the adhesion promoter is 3-aminopropyltriethoxysilane (i.e. 3-(trimethoxysilyl)propylamine).

In one or more embodiments of the invention, the bond adhesive composition may include an adhesion promoter that produces a reduced amount of volatile organic compound compared to that produced by conventional silane adhesion promoters. Adhesion promoters that produce a reduced amount of volatile organic compound compared to that produced by conventional silane adhesion promoters may be referred to as low VOC-generating adhesion promoters. Low VOC-generating adhesion promoters are described, for example, in U.S. Patent Application Pub. Nos. 2006/0205907 A1 and 2008/0237537 A1, both of which are incorporated by reference herein.

Examples of low VOC-generating adhesion promoters include silanes of the general formula:

$$[Y[—G(—SiX_uZ^b_vZ^c_w)_s]_r]_n \quad (1)$$

wherein each occurrence of G is independently a polyvalent group derived from the substitution of one or more hydrogen atoms of an alkyl, alkenyl, aryl or aralkyl group, or a group obtained by removal of one or more hydrogen atoms of a heterocarbon, with G containing from about 1 to about 30 carbon atoms; each occurrence of X is independently —Cl, —Br, $R^1O$—, $R^1C(=O)O$—, hydroxycarboxylic acids, $R^1R^2C=NO$—, $R^1R^2NO$— or $R^1R^2N$—, —$R^1$, —$(OSiR^1R^2)_t(OSiR^1R^2R^3)$, and —$O(R^{10}CR^{11})_fOH$, wherein each occurrence of $R^1$, $R^2$, $R^3$, $R^{10}$, and $R^{11}$ is independently R; each occurrence of $Z^b$ is independently selected from the group consisting of $(—O—)_{0.5}$, $[O(R^{10}CR^{11})_fO—]_{0.5}$, $[—NR^4\text{-}L^1\text{-}NR^5—]_{0.5}$, $[—OC(=O)R^{10}CR^{11}C(=O)O—]_{0.5}$ except succinic, maleic or phthalic acid, an alkanolamine or an acetylenic glycol where these groups form bridging bonds between silicon atom centers, wherein each occurrence of $R^{10}$ and $R^{11}$ is independently R and each occurrence of $L^1$ is independently G; each occurrence of $Z^C$ is independently selected from the group consisting of —$O(R^{10}R^{11})_fO$_, —$NR^4\text{-}L^1\text{-}NR^5$—, —$OC(=O)R^{10}CR^{11}C(=O)O$— except succinic, maleic or phthalic acid, an alkanolamine or an acetylenic glycol where these groups form cyclic bonds with a silicon atom center, wherein each occurrence of $R^{10}$ and $R^{11}$ is independently R and each occurrence of $L^1$ is independently G; each occurrence of R is hydrogen, straight alkyl, cyclic alkyl, branched alkyl, alkenyl, aryl, aralkyl, an ether, polyether, or a group obtained by removal of one or more hydrogen atoms of a heterocarbon; each occurrence of R contains from 1 to about 20 carbon atoms; each occurrence of the subscript f is an integer of from 1 to about 15; each occurrence of n is an integer of from 1 to about 100, with the proviso that when n is greater than 1; v is greater than 0 and all of the valences for $Z^b$ have a silicon atom bonded to them; each occurrence of the subscript u is an integer of from 0 to about 3; each occurrence of the subscript v is an integer of from 0 to about 3; each occurrence of the subscript w is an integer of from 0 to about 1, with the proviso that u+v+2w=3; each occurrence of the subscript r is an integer of from 1 to about 6; each occurrence of the subscript t is an integer of from 0 to about 50; each occurrence of the subscript s is an integer of from 1 to about 6; each occurrence of Y is an organofunctional group of valence r; and at least one cyclic and bridging organofunctional silane comprising the cyclic and bridging organofunctional silane composition containing at least one occurrence of $Z^b$ or $Z^c$.

In one or more embodiments, the low VOC-generating adhesion promoter may be prepared by reaction of an aminoalkylalkoxysilane with an alkane diol. For example, in one or more embodiments, a silane useful as a low VOC-generating adhesion promoter may be prepared by the transesterification of 3-aminopropyltriethoxysilane with 2-methyl-1,3-propanediol.

Catalysts

In one or more embodiments, a catalyst is employed in the primer compositions of this invention. Suitable catalysts may include catalysts for the purpose of promoting the crosslinking the silane-terminated polymer. Without wishing to be bound by any particular theory, it is believed that these catalysts promote the hydrolysis and condensation of organosilicon compounds (i.e., reactions between the terminal groups of the polymer having silicon-containing hydrolyzable terminal groups, and reactions between the optional adhesion promoter when present and the polymer having silicon-containing hydrolyzable terminal groups). In one or more embodiments, hydrolysis of organosilicon compounds may be catalyzed by either acids or bases. Useful basic catalysts that may be employed in the compositions of this invention include alkali metal hydroxides such as potassium hydroxide, silanolates such as lithium silanolate, organic amines, and Lewis bases such as alkali metal carbonates and bicarbonates. Suitable acid catalysts include mineral acids such as sulfuric and phosphoric acids, organic acids such as acetic, propanoic and methane sulfonic acids. Other suitable acid catalysts include Lewis acids such as aluminum chloride, organotin compounds such as dibutyl tin dilaurate and titanium compounds such as the alkyl ortho esters, including tetrabutyl titanate.

Thixotrope

In one or more embodiments, a thixatrope is employed in the primer compositions of this invention. In one or more embodiments, suitable thixotropic agents may include, but are not limited to, polyvinylpyrrolidone, titanate coupling agents, metal soaps (such as calcium stearate, aluminum stearate, and barium stearate, aluminum distearate, and aluminum tristearate), copolymers with acidic groups, compounds having ionic groups, fumed silica, colloidal silica, asbestine, organic derivatives of castor oil (such as hydrogenated castor oil derivatives), treated clays, organic bentonite, modified polyester polyols (such as polyoxyethylene-polyoxypropylene block copolymers), aliphatic amides, and polyamides (such as polyamide waxes). Specific examples include polyamide waxes, such as "Crayvallac SLX" available from Arkema, or polymerized castor oils such as Flowtone R from Crayvalley.

Filler

In one or more embodiments, the primer compositions include a filler. In particular embodiments, the filler is a mineral filler. Useful mineral fillers include, but are not limited to, clays, silicates, titanium dioxide, talc (magnesium silicate), mica (mixtures of sodium and potassium aluminum silicate), alumina trihydrate, antimony trioxide, calcium carbonate, titanium dioxide, silica, magnesium hydroxide, calcium borate ore, fumed silica, and mixtures thereof.

Antidegradants

In one or more embodiments, one or more antidegradants are employed in the primer compositions of this invention. In one or more embodiments, useful anti-degradants include UV-stabilizers, antioxidants, and/or antiozonants. Examples of useful antioxidants include hindered phenols and phosphate esters.

Tackifying Resin

In one or more embodiments, a tackifying resin is employed in the primer compositions of this invention. In one or more embodiments, suitable tackifying resins include aliphatic, cycloaliphatic, aromatic, aliphatic-aromatic, aromatic modified alicyclic, and alicyclic hydrocarbon resins and modified versions and hydrogenated derivatives thereof; terpenes (polyterpenes), modified terpenes (e.g., phenolic modified terpene resins), phenolic resins, and mixture thereof. Other useful tackifying agents are disclosed in, e.g., U.S. Pat. No. 6,355,317 incorporated herein by reference.

Primer—Ingredient Amounts

Silane-Terminated Polymer

In one or more embodiments, the primer compositions include greater than 45 wt %, in other embodiments greater than 50 wt %, and in other embodiments greater than 55 wt % silane-terminated polymer, based upon the entire weight of the primer composition. In these or other embodiments, the primer compositions include less than 80 wt %, in other embodiments less than 75 wt %, and in other embodiments less than 70 wt % silane-terminated polymer, based upon the entire weight of the primer composition. In one or more embodiments, the primer compositions include from about 45% to about 80 wt %, in other embodiments from about 50% to about 75 wt %, and in other embodiments from about 55% to about 70 wt % silane-terminate polymer, based upon the entire weight of the primer composition.

Fillers

In one or more embodiments, the primer compositions include greater than 0.1 weight parts, in other embodiments greater than 0.5 weight parts, and in other embodiments greater than 1 weight parts filler per 100 parts by weight of the silane-terminated polymer component. In these or other embodiments, the primer compositions include less than 10 weight parts, in other embodiments less than 5 weight parts, in other embodiments less than 3 weight parts, in other embodiments less than 1 weight parts, and in other embodiments less than 0.5 weight parts filler per 100 parts by weight of the silane-terminated polymer component. In one or more embodiments, the primer compositions include from about 0.1 to about 10, in other embodiments from about 0.5 to about 3, and in other embodiments from about 1 to about 2 weight parts filler per 100 parts by weight of the silane-terminated polymer component. In one or more embodiments, the primer composition is devoid or substantially devoid of filler.

Adhesion Promoters

In one or more embodiments, the primer compositions include greater than 0.1, in other embodiments greater than 0.5, and in other embodiments greater than 1.0 weight parts adhesion promoter per 100 parts by weight of the silane-terminated polymer component. In these or other embodiments, the primer compositions include less than 10, in other embodiments less than 8, and in other embodiments less than 6 weight parts adhesion promoter per 100 parts by weight of the silane-terminated polymer. In one or more embodiments, the primer compositions include from about 0.1 to about 10, in other embodiments from about 0.5 to about 8, and in other embodiments from about 1.0 to about 6 weight parts adhesion promoter per 100 parts by weight of the silane-terminated adhesion promoter. In one or more embodiments, the primer composition is devoid or substantially devoid of adhesion promoter.

Catalyst

In one or more embodiments, the primer compositions include greater than 0.01, in other embodiments greater than 0.05, and in other embodiments greater than 0.1 weight parts catalyst per 100 parts by weight of the silane-terminated polymer component. In these or other embodiments, the primer compositions include less than 1.0, in other embodiments less than 0.5, and in other embodiments less than 0.3 weight parts catalyst per 100 parts by weight of the silane-terminated polymer. In one or more embodiments, the primer compositions include from about 0.01 to about 1.0, in other embodiments from about 0.05 to about 0.5, and in other embodiments from about 0.1 to about 0.3 weight parts catalyst per 100 parts by weight of the silane-terminated adhesion promoter.

Thixatrope

In one or more embodiments, the primer compositions include greater than 0.1, in other embodiments greater than 1.0, and in other embodiments greater than 2.0 weight parts thixatrope per 100 parts by weight of the silane-terminated polymer component. In these or other embodiments, the primer compositions include less than 10, in other embodiments less than 3.0, and in other embodiments less than 1.0 weight parts thixatrope per 100 parts by weight of the silane-terminated polymer. In one or more embodiments, the primer compositions include from about 0.1 to about 10, in other embodiments from about 0.5 to about 5, and in other embodiments from about 1.0 to about 2.0 weight parts thixatrope per 100 parts by weight of the silane-terminated adhesion promoter. In one or more embodiments, the primer composition is devoid or substantially devoid of thixatrope.

Antidegradants

In one or more embodiments, the primer compositions include greater than 0.1, in other embodiments greater than 1.0, and in other embodiments greater than 2.0 weight parts antidegradant per 100 parts by weight of the silane-terminated polymer component. In these or other embodiments, the primer compositions include less than 10, in other embodiments less than 5.0, and in other embodiments less than 3.0 weight parts antidegradant per 100 parts by weight of the silane-terminated polymer. In one or more embodiments, the primer compositions include from about 0.1 to about 10, in other embodiments from about 0.5 to about 5, and in other embodiments from about 1.0 to about 3.0 weight parts antidegradant per 100 parts by weight of the silane-terminated adhesion promoter. In one or more embodiments, the primer composition is devoid or substantially devoid of antidegradant.

Tackifying Resin

In one or more embodiments, the primer compositions include greater than 0.1, in other embodiments greater than 1.0, and in other embodiments greater than 2.0 weight parts tackifying resin (e.g. hydrocarbon resin) per 100 parts by weight of the silane-terminated polymer component. In these or other embodiments, the primer compositions include less than 10, in other embodiments less than 5.0, and in other embodiments less than 3.0 weight parts tackifying resin (e.g. hydrocarbon resin) per 100 parts by weight of the silane-terminated polymer. In one or more embodiments, the primer compositions include from about 0.1 to about 10, in other embodiments from about 0.5 to about 5, and in other embodiments from about 1.0 to about 3.0 weight parts tackifying resin (e.g. hydrocarbon resin) per 100 parts by weight of the silane-terminated adhesion promoter. In one or more embodiments, the primer composition is devoid or substantially devoid of tackifying resin (e.g. hydrocarbon resin).

Plasticizer

In one or more embodiments, the primer compositions include greater than 15, in other embodiments greater than 25, and in other embodiments greater than 35 weight parts plasticizer per 100 parts by weight of the silane-terminated polymer component. In these or other embodiments, the primer compositions include less than 70, in other embodiments less than 55, and in other embodiments less than 45 weight parts plasticizer per 100 parts by weight of the silane-terminated polymer. In one or more embodiments, the primer compositions include from about 15 to about 70, in other embodiments from about 25 to about 55, and in other embodiments from about 35 to about 45 weight parts plasticizer per 100 parts by weight of the silane-terminated adhesion promoter. In one or more embodiments, the primer composition is devoid or substantially devoid of plasticizer.

Solvent

In one or more embodiments, the primer compositions include greater than 0.01, in other embodiments greater than 0.05, and in other embodiments greater than 1.0 weight parts solvent per 100 parts by weight of the silane-terminated polymer component. In these or other embodiments, the primer compositions include less than 1.0, in other embodiments less than 0.5, and in other embodiments less than 0.1 weight parts solvent per 100 parts by weight of the silane-terminated polymer. In one or more embodiments, the primer compositions include from about 0 to about 10, in other embodiments from about 0.01 to about 5, and in other embodiments from about 0.1 to about 3.0 weight parts solvent per 100 parts by weight of the silane-terminated adhesion promoter. In one or more embodiments, the primer composition is devoid or substantially devoid of solvent where substantially devoid refers to that amount or less that would otherwise have an appreciable impact on the invention.

Characteristics of Uncured Primer Composition

According to aspects of this invention, components of the primer composition react in the presence of atmospheric moisture to form a cured coating layer (i.e. cured or cross-linked primer layer). Accordingly, aspects of the invention may be described with reference to the uncured primer composition, which refers to the composition including those constituents of the composition before appreciable chemical reaction or crosslinking takes place, and to the cured primer layer, which refers to the primer after chemical reaction or crosslinking. In one or more embodiments, the cured primer layer is the cured residue of a primer composition including a silicon-terminated polymer. Stated another way, the cured primer layer is formed from a primer composition that includes polymer with a silicon-containing hydrolysable terminal group that is curable through a moisture curing reaction. In one or more embodiments, the uncured primer composition includes greater than 95 wt %, in other embodiments greater than 98 wt %, and in other embodiments greater than 99 wt % solids. In particular embodiments, the uncured primer composition is 100% solids composition (i.e. it is solvent free).

According to aspects of the present invention, the primer compositions employed in the practice of this invention are tailored to a desired dynamic and static viscosity. This can be achieved by manipulating several parameters such as, but not limited to, the molecular weight of the polymers, the amount of filler, and the use of thixotropic agents.

In one or more embodiments, the primer compositions are characterized by a Brookfield Viscosity, which can be determined by ASTM D789 or D4878 using a #2 spindle at 20 r.p.m. at 23.5° C. and 50% relative humidity. In one or more embodiments, the Brookfield Viscosity (#2 spindle at 20 r.p.m.) of the curable sealant compositions is greater than 300, in other embodiments greater than 400, in other embodiments greater than 500, in other embodiments greater than 600, and in other embodiments greater than 700 centipoise. In these or other embodiments, the of the Brookfield Viscosity (#2 spindle at 20 r.p.m.) of the curable sealant compositions is less than 2500, in other embodiments less than 1500, and in other embodiments less than 1000, in other embodiments less than 900, and in other embodiments less than 800, in other embodiments less than 700, and in other embodiments less than 600 centipoise. In one or more embodiments, the Brookfield Viscosity (#2 spindle at 20 r.p.m.) of the curable sealant compositions is from about 300 to about 2500, in other embodiments from about 400 to about 1500, and in other embodiments from about 400 to about 1000 centipoise, in other embodiments from about 600 to about 900 centipoise, and in other embodiments from about 700 to about 750 centipoise.

In one or more embodiments, the uncured primer compositions are characterized by a tack free time, which can be determined by ASTM C 679 at 20° C. and 50% relative humidity. In one or more embodiments, the tack free time (ASTM C679) of the uncured primer compositions is greater than 1, in other embodiments greater than 2, and in other embodiments greater than 3 minutes. In these or other embodiments, the tack free time of the uncured primer compositions is less than 1 hour, in other embodiments less than 40 minutes, in other embodiments less than 20, in other embodiments less than 15, and in other embodiments less than 10 minutes. In one or more embodiments, the tack free time of the uncured primer compositions is from about 1 to about 20, in other embodiments from about 2 to about 15, and in other embodiments from about 3 to about 10 minutes.

In one or more embodiments, the primer compositions, are characterized by minimal shrinking during the curing process. As the skilled person will appreciate, shrinkage can be quantified by the percent volume change in the composition from the time of application to the time of removal of substantially all of the solvent. In one or more embodiments, the percent shrinkage of the primer compositions employed in this invention is less than 10 volume %, in other embodiments less than 5 volume %, and in other embodiments less than 3 volume %, and in other embodiments less than 1 volume %.

In one or more embodiments, the primer compositions are characterized by a reduced substrate swell, particularly to EPDM membrane at 20° C. and 50% relative humidity. In one or more embodiments, the primer compositions cause an EDPM membrane to swell, after 24 hours of contact time, less than 2%, in other embodiments less than 1%, and in other embodiments less than 0.5%.

In one or more embodiments, the primer compositions are characterized by a relatively low VOC release during the curing process. In one or more embodiments, the primer compositions release, up until complete cure, less than 25, in other embodiments less than 20, and in other embodiments less than 15 grams of VOC/liter of curable sealant composition.

Characteristics of Cured Primer Layer

In one or more embodiments, the cured primer layer lacks adhesive qualities as compared to those layers generally known as pressure-sensitive adhesive layers. For example, a lap seam formed with just two primed surfaces and no tape or other adhesive may be characterized by a peel strength of less than 1.0 pli (1.75 N/cm).

In one or more embodiments, the cured primer layer provides an advantageous surface to which an adhesive can be applied and form a bond with the adhesive that will not serve as the point of failure in a peel test; instead, the adhesive will cohesively fail or the bond between the adhesive and adjoining substrate will fail before the bond between the substrate and the primer layer. For example, the when subjected to standard peels tests, such as those prescribed by ASTM D 413, that employs EPDM substrates and a standard roofing splice tape (e.g. butyl-EPDM blend tape), the bond between the tape and the primer layer will, after 7 days aging at 20° C. and 50% relative humidity, withstand peel forces of greater than 4 pounds per lineal inch (pH), in other embodiments greater than 5 pH, in other embodiments greater than 6 pH, in other embodiments greater than 7 pH, and in other embodiments greater than 7 pH.

Membrane Panel

As indicated above, the methods of the present invention relate to the seaming of adjacent membranes, which may also be referred to as membrane panels. Practice of the present invention is not necessarily limited to the selection of any particular membrane panel.

In one or more embodiments, the membrane panel may be a thermoset material. In other embodiments the membrane may be a thermoformable material. In one or more embodiments, the membrane may be EPDM based. In other embodiments, the membrane may be TPO based. In these or other embodiments, the membrane may be flexible and capable of being rolled up for shipment. In these or other embodiments, the membrane may include fiber reinforcement, such as a scrim. In one or more embodiments, the membrane includes EPDM membranes including those that meet the specifications of the ASTM D-4637. In other embodiments, the membrane includes thermoplastic membranes including those that meet the specifications of ASTM D-6878-03. Still other membranes may include PVC, TPV, CSPE, and asphalt-based membranes.

In one or more embodiments, at least one planar surface of the membrane panel (e.g. a planar surface of an EPDM membrane panel) is coated with or includes surface particulate. In one or more embodiments, the membrane panel is an EPDM membrane panel and at least one surface, and in certain embodiments both surfaces, including mica or talc. In one or more embodiments, a substantial amount of surface particulate is present, which refers to an amount of particulate on the surface of the membrane that that would have an appreciable impact on adhesion of the membrane to an adjoining membrane. In one or more embodiments, the membrane panels include greater than 10 $g/m^2$, in other embodiments greater than 20 $g/m^2$, and in other embodiments greater than 30 $g/m^2$ of surface particulate.

In one or more embodiments, conventional dimensions characterize the roofing membrane panels. For example, in one or more embodiments, the membrane panels may have a thickness of from about 500 μm to about 3 mm, in other embodiments from about 1,000 μm to about 2.5 mm, and in other embodiments from about 1,500 μm to about 2 mm. In these or other embodiments, the membrane panels of the present invention are characterized by a width of about 1 m to about 20 m, in other embodiments from about 2 m to about 18 m, and in other embodiments from about 3 m to about 15 m.

Splice Tape

As described above, the methods of the present invention seam together adjacent roofing membranes through the use of an adhesive that is applied to the surface of a membrane following application of the primer composition (i.e., to the primed surface). In one or more embodiments, the adhesive is a liquid contact adhesive. In other embodiments, the adhesive is a pressure-sensitive adhesive, such as a solids tape. These tapes are generally known and may be referred to as splice tape.

In one or more embodiments, the splice tape may be a 100% solids adhesive, which may also be referred to as a solid adhesive strip. In one or more embodiments, the splice tape includes butyl rubber and/or EPDM, which are often formulated with rubber tackifiers and other optional agents to impart adhesive qualities.

In one or more embodiments the adhesive tapes include at least 85 percent solids, in other embodiments, at least 90 percent solids, in other embodiments, at least 95 percent solids, and in still other embodiments at least 99 percent solids. In one or more embodiments, the adhesive tape has a thickness of greater than 0.007 inches (0.178 mm), in other embodiments, greater than 0.01 inches (0.25 mm), and in still other embodiments, greater than 0.1 inches (2.54 mm).

Useful adhesive tapes are disclosed in U.S. Pat. Nos. 10,508,193, 6,120,869, 5,888,602, 5,859,114, 5,733,621, 5,612,141, 5,563,217, 5,545,685, 5,504,136, 5,242,727, 4,932,171, 4,849,268, 4,657,958, 4,855,172, 4,588,637, 4,539,344, and 4,426,468 which are incorporated herein by reference. Useful tapes are commercially available including those available under the tradenames QuickSeam™ (Firestone), PLIOSEAL™ (Ashland), 510™ (Adco), 505™ (Adco).

Installation of Roof System—Field Application of Primer

In one or more embodiments of the invention, adjacent roofing panels of a roof system can be installed on a roof surface (also known as roof substrate) and adhesively seamed (also known as splicing). Prior to seaming the adjacent membranes, a primer composition is field applied to at least a portion of the upper surface of at least one of the membrane panels (e.g. the lateral edge of at least one of the membrane panels). In a first set of embodiments, the methods of the present invention include field application of the primer composition, followed by adhesively seaming the adjacent membranes. These methods generally include, with possible variation in the order of the steps, (i) positioning membranes in an adjacent manner to provide for overlap between adjacent membranes in the lap region, (ii) securing the membrane panels to a surface of the roof, (iii) applying the primer composition of the present invention to the contact surfaces of the lap region to form primer layers, (iv) applying an adhesive to at least one of the primer layers, and (v) mating the adjacent membranes to form a lap seam.

For example, according to aspects of the invention, membranes can be unrolled on a roof substrate and placed adjacent to each other with an overlap in the seam area. While this technique is well known to those skilled in the art, FIG. 1 shows an exemplary embodiment where roof system 20 includes first membrane panel 22 being partially overlapped by second membrane panel 24 in lap region 27.

Practice of the present invention is not necessarily limited by the selection of any particular roof substrate to which the membranes can be attached in forming the roof systems. In one or more embodiments, the roof substrate may include the roof deck. In other embodiments, the roof substrate may include an intervening construction layer disposed above the roof deck. As the skilled person will appreciate, these intervening layers may include, but are not limited to, insulation boards, cover boards, underlayment, and existing membranes.

The membrane panels are secured to the roof substrate using known techniques. For example, the membrane panels can be fully adhered to the substrate using contact adhesives. In other embodiments, a pressure-sensitive adhesive, pre-applied to the membrane, can be employed. In other embodiments, the membrane panels can be secured to the substrate using mechanical fasteners. In one or more embodiments, the membrane panels are secured or adhered to the substrate prior to forming the lap seam. For example, after securing a first membrane to the roof substrate, a second membrane is positioned adjacent to this first membrane with a portion of the second membrane overlapping the first membrane to form a lap. The second membrane is at least partially secured to the roof substrate and then the lap is seamed. In other embodiments, the lap seam is formed prior to securing or adhering the membranes to the substrate.

Once adjacent membranes are positioned in the appropriate overlapping fashion, the primer composition of this invention is applied to the contact surfaces of the adjacent membranes within the lap region (i.e. the surfaces that contact each other in the formation of the seam). Application of the primer composition forms a primer layer, which may also be referred to as a primer film or a primed surface of the membrane. With reference to FIG. 1, a primer layer 26 is formed on a portion of a first surface 23 of first membrane panel 22 generally in lap area 27. And, a primer layer 28 is formed on a portion of a first surface 25 of second membrane panel 24 generally in lap area 27. Surface 23 can 25 may be referred to as contact surfaces.

In one or more embodiments, the primer composition can be applied to the membrane panel by using conventional techniques such as brushing, spraying, and rolling. In particular embodiments, the primer composition can be applied to the lap region by employing an abrasive instrument, such as an abrasive pad, which allows for application of the primer composition by using a scrubbing technique. Methods and techniques for field application of a primer composition to the lap edge of a membrane are generally known in the art as described in U.S. Pat. Nos. 5,520,761 and 5,976,292, which are incorporated herein by reference.

In one or more embodiments, the primer composition is applied at a coverage rate of greater than 100, in other embodiments greater than 125, and in other embodiments greater than 150 square feet per gallon. In these or other embodiments, the primer composition is applied at a rate of less than 250, in other embodiments less than 225, and in other embodiments less than 200 square feet per gallon. In one or more embodiments, the primer composition is applied at a rate of from about 100 to about 250, in other embodiments from about 125 to about 225, and in other embodiments from about 150 to about 200 square feet per gallon.

In one or more embodiments, after applying the primer composition to the membrane panel, sufficient time is provided to allow the primer to at least partially cure. In one or more embodiments, the primer composition may be subjected to heat or moisture to cause a crosslinking of one or more of the crosslinkable polymers within the primer composition. In one or more embodiments, the time period provided to allow the primer composition to cure prior to application of an adhesive is greater than 0.5 min, in other embodiments greater than 1 min, and in other embodiments greater 3 min. In these or other embodiments, the time period provided to allow the primer composition to cure prior to application of the adhesive is less than 60 min, in other embodiments less than 30 min, and in other embodiments less than 15 min. In one or more embodiments, the time period provided to allow the primer composition to cure prior to applying the adhesive is from about 0.5 to about 60 min, in other embodiments from about 1 to about 30 min, and in other embodiments from about 3 to about 15 min.

As indicated above, the primer layer (e.g. layers 26, 28) is generally disposed on the surface of the membrane generally in the lap area (e.g. lap area 27 as shown in FIG. 1). The primer layer may extend beyond the lap area, but for various reasons, it may be desirable to limit the primer layer outside of the lap area. In one or more embodiments, the primer layer includes or occupies less than 20%, in other embodiments less than 10%, and in other embodiments less than 5% of the surface area of the planar surface of the membrane to which it is applied. (e.g. surface 23 of membrane 22). In these or other embodiments, primer layer is formed extending along the lateral edge of membrane panel (i.e., extends along a longitudinal length of membrane panel) and extends inwardly from the edge (i.e., perpendicular to the edge) greater than 1 cm, in other embodiments greater than 2 cm, and in other embodiments greater than 3 cm. In these or other embodiments, the primer layer extends along the lateral edge of the membrane panel and extends inwardly from the edge less than 30 cm, in other embodiments less than 20 cm, and in other embodiments less than 15 cm. In one or more embodiments, the primer layer extends along the lateral edge of the membrane panel and extends inwardly from the edge a distance of from about 1 to about 30, in other embodiments from about 2 to about 20, and in other embodiments from about 3 to about 15 cm.

In one or more embodiments, the primer layers (e.g. layers 26, 28) may have a thickness of greater than 6 μm (0.25 mil), in other embodiments greater than 12 μm (0.5 mil), in other embodiments greater than 25 μm (1 mil), in other embodiments greater than 38 μm (1.5 mil), in other embodiments greater than 51 μm (2 mil), and in other embodiments greater than 64 μm (2.5 mil). In these or other embodiments, the primer layer has a thickness of less than 178 μm (7 mil), in other embodiments less than 127 μm (5 mil), and in other embodiments less than 76 μm (3 mil). In one or more embodiments, the adhesive layer has a thickness of from about 6 to about 178 μm (about 0.25 to about 7 mil), in other embodiments from about 25 to about 127 μm (about 1 to about 5 mil), and in other embodiments from about 51 to about 76 μm (about 2 to about 3 mil).

Once the primer layer is formed on the contact surfaces of adjacent membranes within the lap region, an adhesive is applied for the purpose of seaming (which may also be referred to as splicing) the adjacent membranes. Where a contact adhesive is employed, the contact adhesive can be applied to one or both of the primer layers. Where a tape adhesive is employed, it is generally desirable to apply the tape to one membrane, typically the lower membrane within the splice. The positioning of the splice can be understood with reference to FIG. 1, which shows tape 30 disposed between primer layers 26 and 28, which are applied to membranes 22 and 24, respectively. Specifically, primer layer 26 is applied to a portion of the upper surface 23 of membrane 22, and primer layer 28 is applied to a portion of the lower surface 25 of membrane 24. Generally, splice tapes are applied by using conventional procedures which may include manual application of the tape or by way of tape dispensing machines. Machines of this nature, which may be referred to as tape applicators, are generally known in the art as shown in U.S. Publ. Nos. 2004/0129387, 2007/0125474, 2006/0226168, and 2010/0269981, which are incorporated herein by reference.

Once the adhesive is positioned, and optionally provided time to at least partially cure in the case of a contact adhesive, the seam can be formed by joining the contact surfaces to the adhesive. Where the seam tape carries a release liner, the process of the invention may include the step of removing the release liner in order to expose the adhesive. Again, with reference to FIG. 1, the adjacent membranes are positioned in overlapping fashion within the seam area to thereby sandwich the adhesive between the primer layers. Once mated, the seam can be further secured by applying pressure to the top surface of the overlapping membrane. This may include the use of rollers or other conventional tools or apparatus that allow for the efficient application of pressure to mate the membranes in the formation of a seam.

The skilled person appreciates that these methods can be performed in multiple sequences. For example, the seam can be formed between the first and second membranes prior to securing the membranes to the roof substrate. Or, the first membrane secured to the substrate can be positioned in an overlapping fashion to an adjacent membrane that is subsequently set in place. In other words, those performing the installation can, as a matter of preference, elect which of the adjacent membranes form the overlapping portion of the lap.

Once the seam is formed, a lap sealant may optionally be applied at the seam. For example, and with reference to FIG. 1, a lap sealant may be applied at the location 29 where membrane 24 terminates in an overlapping manner on membrane 22 (i.e. at the lap edge) and extend down to membrane 22 so as to cover and seal both primer layers 26, 28, as well as tape 30.

Installation of Roof System—Pre-Primed Membrane

In one or more embodiments of the invention, membrane panels that are pre-primed with the primer compositions of this invention can be received at the location of installation and installed by forming an adhesive seam between adjacent roofing panels. According to embodiments, pre-primed panels are membrane panels that have been primed with the primer composition of this invention within a fabrication facility and delivered to the location where they are to be installed. According to these embodiments, the methods of the present invention include, with possible variation in the order of the steps, (i) receiving membrane panels carrying a primer layer in a lap area of the membrane panel; (ii) positioning membranes in a manner to provide for overlap between adjacent membranes in the lap region, (iii) securing the membranes to the roof substrate, (iv) applying an adhesive to at least one of the primed surfaces, and (v) mating the adjacent membranes to form a lap seam.

Figure 2:
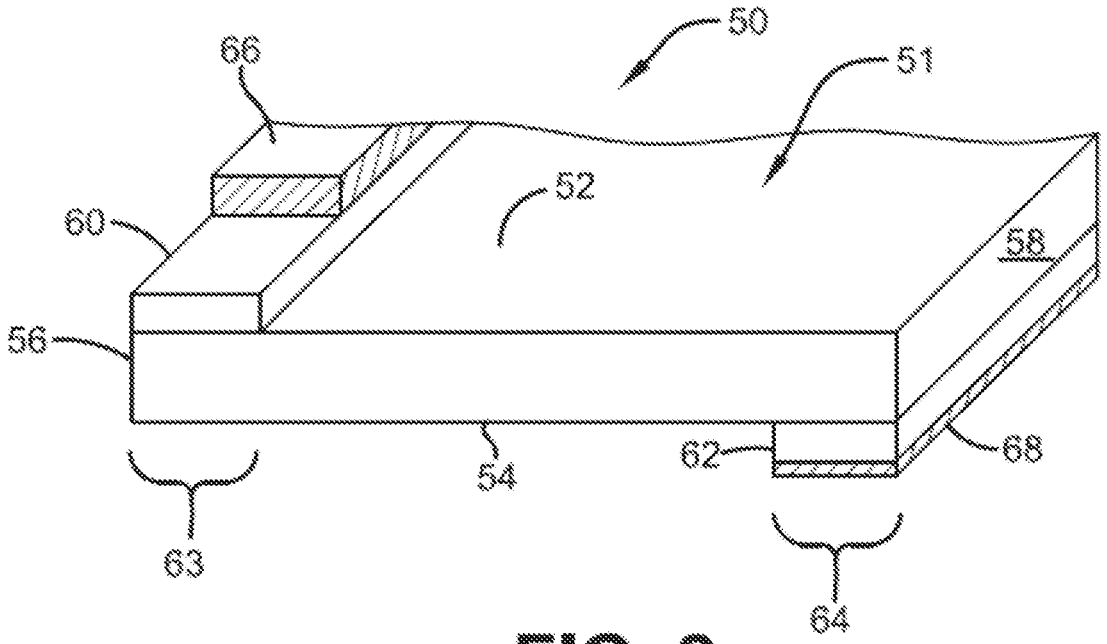
FIG. 2 is a perspective elevational view of a pre-primed roofing membrane panel according to embodiments of the invention.

The pre-primed membrane panels according to embodiments of the invention can be described with reference to FIG. 2, which shows pre-primed membrane panel 50 including membrane panel 51 including top planar surface 52 and bottom planar surface 54 opposite top planar surface 52. Membrane panel 50 also includes first lateral edge 56 and second lateral edge 58 opposite first lateral edge 56, with each edge extending longitudinally down the length of the membrane. In one or more embodiments, a first primer layer 60 is disposed on top planar surface 52 along first lateral edge 56 and generally covers a lap region 63 of top planar surface 52. In one or more embodiments, a second primer layer 62 is optionally disposed on bottom planar surface 54 along second lateral edge 58 and generally a lap region 64 of bottom planar surface 54. In one or more embodiments, first primer layer 60 may optionally carry a first release liner 66 and second primer layer 62 may optionally carry a second release liner 68. The skilled person appreciates the benefits associated with application of the primer composition on top surface 52 along first lateral edge 56 and application of the primer composition on the opposite surface (i.e. bottom surface 54) along the opposite edge (i.e. second lateral edge 58), which facilitates placement of adjacent membranes in overlapping position.

The characteristics of the membrane panel and the primer layer of the pre-primed membrane panels may be the same as set forth above with regard to the field applied primer embodiments described above, and therefore the description from above is incorporated into these embodiments.

In one or more embodiments, the optional release liner (e.g. liner 66, 68), which may also be referred to as release member, may include a polymeric film or extrudate, or in other embodiments it may include a coated cellulosic substrate. The polymeric film or extrudate may include a single polymeric layer or may include two or more polymeric layers laminated or coextruded to one another. Suitable materials for forming a release member that is a polymeric film or extrudate include polypropylene, polyester, high-density polyethylene, medium-density polyethylene, low-density polyethylene, polystyrene or high-impact polystyrene. The coating or layer applied to the film and/or cellulosic substrate may include a silicon-containing or fluorine-containing coating. For example, a silicone oil or polysiloxane may be applied as a coating. In other embodiments, hydrocarbon waxes may be applied as a coating. As the skilled person will appreciate, the coating, which may be referred to as a release coating, can be applied to both planar surfaces of the film and/or cellulosic substrate. In one or more embodiments, the release member is characterized by a thickness of from about 15 to about 80, in other embodiments from about 18 to about 75, and in other embodiments from about 20 to about 50 μm.

According to embodiments of the invention, the pre-primed membranes may be received at the location of installation in the form of a roll. The membranes can then be delivered to the roof structure and unrolled for installation. Consistent with previous embodiments, adjacent membranes can be placed in adjacent arrangement, secured to the roof substrate, and an adhesive is applied to at least one primed surface of at least one of the adjacent membranes. These steps are the same or similar to those embodiments where the primer is field applied, and therefore the description relative to the placement of the membrane, the application of the adhesive, and forming of the seam provided above with respect to those embodiments is incorporated herein. The skilled person will appreciate that where the pre-primed membranes carry a release member, which may be included to keep the primer layer clean, the method the present includes removal of the release member prior to application of the adhesive. Also, those skilled in the art will appreciate that the membrane panel, which may include a primed layer disposed on the top and bottom surfaces on opposite lateral edges, installation of the membrane panel requires proper alignment of the primed surfaces relative to the manner in which the seam will be formed.

Installation of Roof System—Membrane Composite

In one or more embodiments of the invention, membrane composite panels according to the invention can be received at the location of installation and installed by forming an adhesive seam between adjacent roofing panels. According to embodiments, membrane panels are primed with the primer composition of this invention and an adhesive is applied to the primed surface within a fabrication facility, and then the composite is delivered to the location where they are to be installed. According to these embodiments, the methods of the present invention include, with possible variation in the order of the steps, (i) receiving membrane composite panels; (ii) positioning the membrane composites in a manner to provide for overlap between adjacent membranes in the lap region, (iii) securing the membrane panels to the roof substrate, and (iv) mating the adjacent membranes to form a lap seam.

Figure 3:
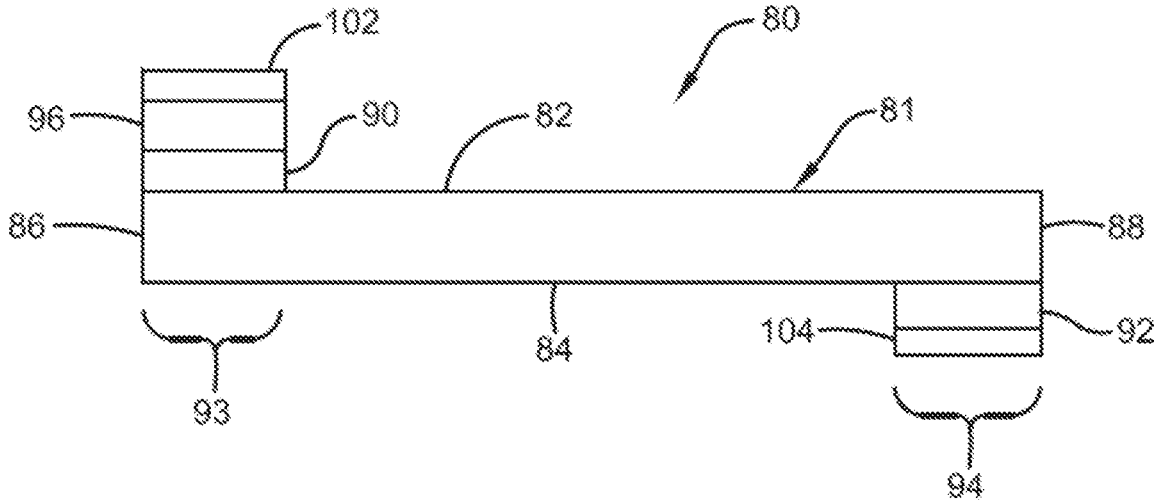
FIG. 3 is a cross-sectional side view of a roofing membrane composite according to embodiments of the present invention.

The composite membrane panels according to embodiments of the invention can be described with reference to FIG. 3, which shows composite membrane panel 80 including membrane panel 81 including top planar surface 82 and bottom planar surface 84 opposite top planar surface 82. Membrane panel 80 also includes first lateral edge 8 and second lateral edge 88 opposite first lateral edge 86. In one or more embodiments, a first primer layer 90 is disposed on top planar surface 82 along first lateral edge 86 and generally covers a lap region 93 of top planar surface 82. In one or more embodiments, a second primer layer 92 is optionally disposed on bottom planar surface 84 along second lateral edge 88 and generally covers a lap region 94 of bottom planar surface 84. An adhesive layer 96 is disposed on first primer layer 90 and extends along lateral edge 86. In one or more embodiments, adhesive layer 96 carries a first release liner 102. In one or more embodiments, second primer layer 92 may optionally carry a second release liner 104. The skilled person appreciates the benefits associated with application of the primer composition on top surface 82 along first lateral edge 86 and application of the primer composition on the opposite surface (i.e. bottom surface 84) along the opposite edge (i.e. second lateral edge 88), which facilitates placement of adjacent membranes in overlapping position.

The characteristics of the membrane panel, the primer layer, the adhesive tape (e.g. adhesive tape layer) and the release member may be the same as set forth above with regard to the field applied primer embodiments and pre-primed membrane embodiments described above, and therefore those descriptions from above are incorporated into these embodiments.

According to embodiments of the invention, the membrane composites may be received at the location of installation in the form of a roll. The membrane composites can then be delivered to the roof structure and unrolled for installation. Consistent with previous embodiments, adjacent membranes can be placed in adjacent arrangement and secured to the roof substrate. These steps are the same or similar to those embodiments where the primer is field applied, and therefore the description relative to the placement of the membrane and forming of the seam provided above with respect to those embodiments is incorporated herein. The skilled person will appreciate that where the composite membranes carry a release member, the method the present includes removal of the release member to expose the adhesive. Also, those skilled in the art will appreciate that the membrane panel, which may include an adhesive layer disposed on the top and a primer layer on the opposed bottom surface on the opposite lateral edge, installation of the membrane panel requires proper alignment of the adhesive layer and primer layer of the adjacent membranes relative to the manner in which the seam will be formed.

Preparation of Pre-Primed or Membrane Composite

As suggested above, the membrane composite panels employed in the practice of this invention may be prepared in a factory or fabrication facility prior to delivery to the location of installation. In one or more embodiments, the manufacture of the membrane composite takes place by providing a polymeric membrane panel. In one or more embodiments, the membrane panel may be provided by employing conventional techniques. For example, thermoplastic membrane panels may be formed by the extrusion of thermoplastic compositions into one or more layers that can be laminated into a membrane panel. Thermoset membranes can be formed using known calendering and curing techniques. Alternatively, thermoset membranes can be made by continuous process such as those disclosed in WO 2013/142562, which is incorporated herein by reference.

As suggested above, in one or more embodiments, the primer is applied in the lap area or region of the membrane. Where the primer is factory applied, methods for providing a membrane with a factory-applied primer are generally known in the art as described in U.S. Publ. Nos. 2007/0264471, 2010/0024955, 2011/0198023, 2010/0200148, and 2013/0295295, which are incorporated herein by reference. In one or more embodiments, the primer composition is applied using conventional techniques such as by roll, slot die, spray, metering rod, or extrusion coating techniques. In particular embodiments, the primer composition is applied by spraying. For example, the composition can be sprayed by employing air, electric, hydraulic and airless spray equipment.

Following application of the primer composition and, if required, a curing step or appropriate time to allowing curing, the adhesive is applied to at least one of the primer layers. Several techniques are known for the factory application of splice tape to a roofing membrane. These methods include the continuous application of tape by using automated laminating equipment. These techniques typically laminate the tape to the membrane while the membrane undergoes unrolling and subsequent rolling. Other techniques include the use of a tape dispensing apparatus on a fabrication floor within a fabrication facility. Typically, the tape carries the release liner prior to laminating the adhesive to the membrane and therefore subsequent steps of applying a release liner can be eliminated. In other embodiments, a release member is subsequently applied. Once the respective layers are applied to the membrane panel, the membrane panel is cut to length and rolled on itself for subsequent storage and shipment to the installation site.

Various modifications and alterations that do not depart from the scope and spirit of this invention will become apparent to those skilled in the art. This invention is not to be duly limited to the illustrative embodiments set forth herein.

What is claimed is:

1. A method of installing a roof system, the method comprising:

(i) securing a first membrane panel to a roof substrate, the first membrane panel including a first polymeric planar body having a top planar surface and a bottom planar surface;

(ii) positioning a second membrane panel adjacent to the first membrane panel so that the second membrane panel overlaps the first membrane panel in a lap region, the second membrane panel including a second polymeric planar body having a top planar surface and a bottom planar surface;

(iii) field applying, at a location of the roof system, a primer composition to at least one of the top planar surface of the first membrane panel and the bottom planar surface of the second membrane panel, in the lap region, to form a first primed surface, where the primer composition includes a silyl-terminated polymer, wherein the silyl-terminated polymer includes a polyurethane backbone, and wherein the field applying the primer composition forms a primer layer that has a thickness of from about 6 μm to about 178 μm;

(iv) applying an adhesive to the first primed surface; and (v) seaming the first membrane panel to the second membrane panel with the adhesive.

2. The method of claim 1, where the primer composition is characterized by a Brookfield Viscosity (#2 spindle at 20 r.p.m.) of less than 1500 centipoise.

3. The method of claim 1, where the first membrane panel and the second membrane panel are cured rubber membranes.

4. The method of claim 1, where the primer composition further includes a moisture scavenger.

5. A method of installing a roof system, the method comprising:

(i) securing a first membrane panel to a roof substrate, the first membrane panel including a polymeric planar body having a top planar surface and a bottom planar surface;

(ii) positioning a second membrane panel adjacent to the first membrane panel so that the second membrane panel overlaps the first membrane panel in a lap region, the second membrane panel including a polymeric planar body having a top planar surface and a bottom planar surface, where a primer layer is present in the lap region on at least one of the top planar surface of the first membrane and the bottom planar surface of the second membrane, where the primer layer has a thickness of from about 6 μm to about 178 μm;

(iii) applying an adhesive to the primer layer; and (iv) seaming the first membrane panel to the second membrane panel with the adhesive, where the primer layer is pre-formed prior to delivery to the roof substrate by applying a primer composition including a silyl-terminated polymer, where the silyl-terminated polymer includes a polyurethane backbone.

6. A method of installing a roof system, the method comprising:

(i) securing a first membrane panel to a roof substrate, the first membrane panel including a polymeric planar body having a top planar surface and a bottom planar surface, where the first membrane panel includes a primer layer on the top planar surface in a lap region of the first membrane panel and an adhesive layer disposed on the primer layer, where the primer layer has a thickness of from about 6 μm to about 178 μm;

(ii) positioning a second membrane panel adjacent to the first membrane panel so that the second membrane panel overlaps the first membrane panel in the lap region, the second membrane panel including a polymeric planar body having a top planar surface and a bottom planar surface; and (iii) seaming the first membrane panel to the second membrane panel with the adhesive layer, where the primer layer is pre-formed on the top planar surface of the first membrane panel prior to delivery to the roof substrate by applying a primer composition including a silyl-terminated polymer, where the silyl-terminated polymer includes a polyurethane backbone, and where the adhesive layer is pre-applied to the primer layer of the first membrane panel prior to delivery to the roof substrate.

7. The method of claim 1, where the primer composition further includes an adhesion promoter.

8. The method of claim 1, where the primer composition further includes a catalyst.

9. The method of claim 1, where the primer composition further includes a tackifier resin.

10. The method of claim 1, where the primer composition further includes a moisture scavenger, an adhesion promoter, a catalyst, and a tackifier resin.

11. The method of claim 1, where the field applying the primer composition applies the primer composition to the top planar surface of the first membrane panel, further comprising field applying an additional amount of the primer composition to the bottom planar surface of the second membrane panel in the lap region to form a second primed surface, prior to the seaming.

12. The method of claim 5, where the primer layer is present on the top planar surface of the first membrane, and where a second primer layer is present in the lap region on the bottom planar surface of the second membrane, where the second primer layer is pre-formed prior to delivery to the roof substrate by applying an additional amount of the primer composition including the silyl-terminated polymer.

13. The method of claim 6, where a second primer layer is present in the lap region on the bottom planar surface of the second membrane panel, where the second primer layer is pre-formed on the bottom planar surface of the second membrane panel prior to delivery to the roof substrate by applying an additional amount of the primer composition including the silyl-terminated polymer.

* * * * *